US006926587B2

(12) United States Patent
Takeuchi

(10) Patent No.: US 6,926,587 B2
(45) Date of Patent: Aug. 9, 2005

(54) CMP APPARATUS, CMP POLISHING METHOD, SEMICONDUCTOR DEVICE AND ITS MANUFACTURING METHOD

(75) Inventor: Junichi Takeuchi, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 10/803,484

(22) Filed: Mar. 18, 2004

(65) Prior Publication Data

US 2004/0242126 A1 Dec. 2, 2004

(30) Foreign Application Priority Data

Mar. 19, 2003 (JP) ..... 2003-076238

(51) Int. Cl.[7] ..... B24B 49/00
(52) U.S. Cl. ..... 451/11; 451/5; 451/36
(58) Field of Search ..... 451/11, 5, 36, 451/60, 65, 66, 285, 286, 287, 288, 290

(56) References Cited

U.S. PATENT DOCUMENTS 6,111,634 A * 8/2000 Pecen et al. ..... 356/72
6,336,845 B1 * 1/2002 Engdahl et al. ..... 451/41
6,346,036 B1 * 2/2002 Halley ..... 451/285
6,520,895 B2 * 2/2003 Senga et al. ..... 483/1
6,527,621 B1 * 3/2003 Halley ..... 451/5
6,729,943 B2 * 5/2004 Kistler et al. ..... 451/286
6,776,692 B1 * 8/2004 Zuniga et al. ..... 451/41

* cited by examiner

*Primary Examiner*—Joseph J. Hail, III
*Assistant Examiner*—Alvin J. Grant
(74) *Attorney, Agent, or Firm*—Harness, Dickey & Pierce, P.L.C.

(57) ABSTRACT

A CMP apparatus is provided for polishing wafers that are substrates to be polished by CMP. The CMP apparatus comprises a stage that is structured to be rotatable and holds a wafer to be polished, a polishing head holding section that holds a polishing head equipped with a polishing pad over the stage, a polishing head storage section that stores replacement polishing heads equipped with polishing pads; and a polishing head replacement mechanism that replaces the polishing head held by the polishing head holding section with the replacement polishing heads stored in the polishing head storage section.

22 Claims, 4 Drawing Sheets

CM P APPARATUS, CMP POLISHING METHOD, SEMICONDUCTOR DEVICE AND ITS MANUFACTURING METHOD

RELATED APPLICATIONS

This application claims priority to Japanese Patent Application No. 2003-076238 filed Mar. 19, 2003 which is expressly incorporated by reference herein in its entirety.

BACKGROUND

1. Technical Field of the Invention

The present invention relates CMP apparatuses, CMP polishing methods, semiconductor devices and methods for manufacturing the same. In particular, the present invention relates to CMP apparatuses that can control cross-contamination even when plural types of polishing processings are conducted with a single apparatus, CMP polishing methods, semiconductor devices and methods for manufacturing the same.

2. Conventional Technology

FIG. 4 schematically shows a cross-sectional view of the structure of a conventional CMP apparatus.

A CMP apparatus 101 includes a turntable 102 in the shape of a disk, and a rotation motor (not shown) is disposed through a rotary shaft below the turntable 102. The turntable 102 is structured such that it normally rotates around its central axis 103. A polishing pad 104 is attached to the upper surface of the turntable 102. The polishing pad 104 includes a lining layer 105, which acts as an interface between a cover layer 106 that is used with a slurry for polishing a wafer 107 and the turntable 102.

A polishing head 108, which is a wafer holding device, is disposed above the turntable 102, and a rotation motor (not shown) is disposed through a rotary shaft 109 above the polishing head 108. The polishing head 108 is structured in a manner that it rotates around its central axis 110. The rotary shaft 109 is supported through an arm 111.

Also, a nozzle (not shown) that discharges a slurry (not shown) onto a central section of the polishing pad 104 is disposed above the turntable 102.

A dresser 112 that prepares the surface condition of the polishing pad 104 is disposed above the turntable 102, and the dresser 112 is mounted on a parallel motion arm 113. The dresser 112 is structured such that it can move in directions indicated by arrows by a moving device (not shown).

When the wafer 107, which is a substrate to be polished, is polished by the CMP apparatus 101, for example, a silicon oxide film is initially deposited on the wafer 107. Then, the back surface of the wafer 107 is attached by a vacuum to the bottom section of the polishing head 108. Then, the turntable 102 is rotated by the rotation motor in a direction indicated by an arrow shown in FIG. 4, and a slurry is discharged from the nozzle such that the slurry is dropped (applied) adjacent the center of the polishing pad 104.

Then, the polishing head 108 is rotated by the rotation motor around the center axis 110, and a surface (polishing surface) of the wafer 107 is pressed against the polishing pad 104. By this, the silicon oxide film on the wafer 107 is polished. Then, the wafer 107 may be polished while the dresser 112 is constantly pressed against the polishing pad 104 to smooth the surface condition thereof. Or, each time the wafer is polished for a predetermined period of polishing time, the dresser 112 may be pressed against the polishing pad 104 to smooth the surface condition thereof.

It is noted that a CMP process is used to planarize a film formed on a substrate to be polished. The target film may be one of a variety of films such as a $SiO_2$ film, Cu film, and W film. The CMP apparatus is mainly composed of a polishing agent called a slurry and polishing cloths called a polishing pad, as described above, in which a wafer that is a substrate to be polished is polished by rotating the wafer and the polishing pad while the slurry is coated on the wafer. Further, there are a plurality of steps in a semiconductor processing which require a CMP apparatus, such as, STI (Shallow Trench Isolation), steps for wiring multiple layers, and the like. However, in order to control cross-contamination among different steps (for example, metal contaminants that are generated in the steps of wiring multiple layers entering in transistor structural sections in the STI step), polishing steps are conventionally conducted by using independent CMP apparatuses for different steps, respectively.

In such a conventional CMP apparatus, independent apparatuses, although the apparatuses have the same hardware structure, need to be used to prevent contamination. The processings with the independent apparatuses may be effective in terms of preventing cross-contamination among different steps. However, they are very inefficient in view of the production, such as, the investment cost for the CMP apparatuses.

In other words, in view of the investment cost, when different CMP apparatuses are installed for different steps, the cost for the apparatuses increases as compared to the case when a plurality of processing steps are conducted by a single CMP apparatus. Also, even when a plurality of CMP apparatuses are installed for different steps, if a substantially large amount of polishing Work needs to be conducted in one of the steps, and if it exceeds the entire processing capacity of the CMP apparatus used in that step, the efficiency of the processing capacity in that particular step reaches the limit, and the production efficiency cannot be improved further. In contrast, when a plurality of processing steps can be performed by each CMP apparatus, and if a large amount of polishing work needs to be conducted in one of the steps, another CMP apparatus that is used in another of the steps can be used. Accordingly, a reduction in the efficiency due to the limit of processing capacity can be prevented, and the rate of production (lead time) can be stabilized by expanding production paths.

The present invention has been made in view of the circumstances described above, and one object is to provide CMP apparatuses that can control cross-contamination even when plural types of polishing processings are conducted with a single apparatus, CMP polishing methods, semiconductor devices and manufacturing methods therefore.

SUMMARY

To solve the problems described above, a CMP apparatus in accordance with the present invention is a CMP apparatus for polishing a substrate to be polished by CMP, and the CMP apparatus comprises: a stage that is structured to be rotatable and holds a substrate to be polished; a polishing head holding section that holds a polishing head equipped with a polishing pad over the stage; a storage section that stores a replacement polishing head equipped with a polishing pad; and a polishing head replacement mechanism that replaces the polishing head held by the polishing head holding section with the replacement polishing head stored in the storage section.

By the CMP apparatus described above, the polishing head replacement mechanism is used to replace the polishing head held by the polishing head holding section with the replacement polishing head stored in the storage section, such that plural types of polishing objects can be polished with a single CMP apparatus, and cross contamination that may cause problems in those instances can be restrained. In other words, in the conventional art, to prevent cross contamination among different steps, independent CMP apparatuses need to be used for different polishing objects, respectively. In contrast, in the CMP apparatus described above, cross contamination can be restrained even when plural types of polishing processings are conducted with a single apparatus.

Also, in the CMP apparatus in accordance with the present invention, the storage section may include storage chambers that store replacement polishing pads, and the storage chambers can be partitioned from one another such that a slurry and contaminants are prevented from crossing from one to the other of the storage chambers.

A CMP apparatus in accordance with the present invention concerns a CMP apparatus for polishing a substrate to be polished by CMP, and the CMP apparatus comprises: a plurality of polishing processing chambers disposed on a turntable; a stage that is disposed in each of the polishing processing chambers, structured to be rotatable, and holds a substrate to be polished; a polishing head holding section that holds a polishing head equipped with a polishing pad over the stage; a storage section that stores a replacement polishing head equipped with a polishing pad; and a polishing head replacement mechanism that replaces the polishing head held by the polishing head holding section with the replacement polishing head stored in the storage section, wherein the polishing processing chambers are mutually partitioned such that a slurry and contaminants are prevented from crossing from one to the other of the polishing processing chambers.

Also, the CMP apparatus in accordance with the present invention may further be equipped with a load-unload chamber that is disposed over the turntable for mounting and removing the substrate to be polished on and from the stage.

Also, in the CMP apparatus in accordance with the present invention, the polishing pad may preferably have a diameter smaller than a diameter of the substrate to be polished.

Also, the CMP apparatus in accordance with the present invention may preferably be further equipped with a pure water circulation system that circulates pure water at the storage section such that the polishing pad stored in the storage section does not dry, and a mechanism that submerges the polishing pad in the storage section in pure water or a mechanism that sprays mist on the polishing pad in the storage section. Accordingly, even when a slurry adheres to a polishing pad once used, the slurry can be prevented from drying up.

Also, the CMP apparatus in accordance with the present invention may be further equipped with a slurry supply system that supplies a slurry at a central section of the polishing pad of the polishing head that is held by the polishing head holding section, wherein the slurry supply system may include a plurality of slurry supply systems that supply the slurry, and a switching device that switches the slurry supply systems.

Also, in the CMP apparatus in accordance with the present invention, the plurality of slurry supply systems may include a circulation system that circulates the slurry in the slurry supply systems while the slurry is not supplied to the polishing pad. As a result, the slurry which is a mixture of liquid and grinding particles is prevented from separating into the liquid and the grinding particles, and precipitation of the grinding particles can be prevented.

Also, the CMP apparatus in accordance with the present invention may further be equipped with a pure water supply device that supplies pure water at a central section of the polishing pad of the polishing head that is held by the polishing head holding section.

A semiconductor device in accordance with the present invention is characterized in being manufactured through the steps of polishing using the CMP apparatus described above.

A method for manufacturing a semiconductor device in accordance with the present invention is characterized in comprising the steps of polishing using the CMP apparatus described above.

A CMP polishing method in accordance with the present invention concerns a CMP polishing method using a CMP apparatus comprising a stage that is structured to be rotatable and holds a substrate to be polished, a polishing head holding section that holds a polishing head equipped with a polishing pad over the stage, a storage section that stores a replacement polishing head equipped with a polishing pad, and a polishing head replacement mechanism that replaces the polishing head held by the polishing head holding section with the replacement polishing head stored in the storage section, and the CMP polishing method comprises the steps of: polishing a substrate to be polished through holding the substrate to be polished on the stage, rotating the stage, and pressing the polishing pad against a polishing surface of the substrate to be polished while rotating the polishing head held by the polishing head holding section.

A CMP polishing method using a CMP apparatus for polishing a substrate to be polished by CMP, the CMP apparatus comprising a plurality of polishing processing chambers disposed on a turntable, a stage that is disposed in each of the polishing processing chambers, structured to be rotatable, and holds a substrate to be polished, a polishing head holding section that holds a polishing head equipped with a polishing pad over the stage, a storage section that stores a replacement polishing head equipped with a polishing pad, and a polishing head replacement mechanism that replaces the polishing head held by the polishing head holding section with the replacement polishing head stored in the storage section, wherein the polishing processing chambers are mutually partitioned such that a slurry and contaminants are prevented from crossing from one to the other of the polishing processing chambers, the CMP polishing method comprising the steps of: polishing a first substrate to be polished through holding the first substrate to be polished on the stage, rotating the stage, and pressing the polishing pad against a polishing surface of the first substrate to be polished while rotating the polishing head held by the polishing head holding section; removing the first substrate to be polished from the stage upon completion of the polishing, replacing the polishing head held by the polishing head holding section with the replacement polishing head, holding a second substrate to be polished having a polishing object different from the first substrate to be polished on the stage, and polishing the second substrate to be polished by rotating the stage, and pressing the polishing pad against a polishing surface of the second substrate to be polished while rotating the polishing head.

A semiconductor device in accordance with the present invention is characterized in being manufactured through the steps of polishing using the CMP polishing method described above.

A method for manufacturing a semiconductor device in accordance with the present invention comprises the steps of polishing using the CMP polishing method described above.

DETAILED DESCRIPTION

A CMP apparatus having a mechanism that can prevent cross contamination even when different types of films are processed with a single apparatus has been invented.

CMP apparatuses are mainly divided into two systems, i.e., a face-down system in which multiple wafers are set facing downward, and ground against a pad having a large diameter (about 1 meter in diameter) and a face-up system in which one wafer is set facing upward, and a pad having a small diameter (about 30 cm in diameter) is pressed against it from above. Although each of the systems has its advantages and disadvantages, the present invention relates to one using a pad of a small diameter that is used in the face-up system.

To prevent contamination, impurities at portions that are in contact with a wafer, in other words, portions between a polishing pad and slurry and a stage, may need to be controlled. By incorporating in the apparatus a mechanism that automatically replaces these portions according to the processing steps and/or objects to be polished, contamination caused by these portions can be suppressed.

An embodiment of the present invention is described below with reference to the accompanying drawings.

Figure 1:
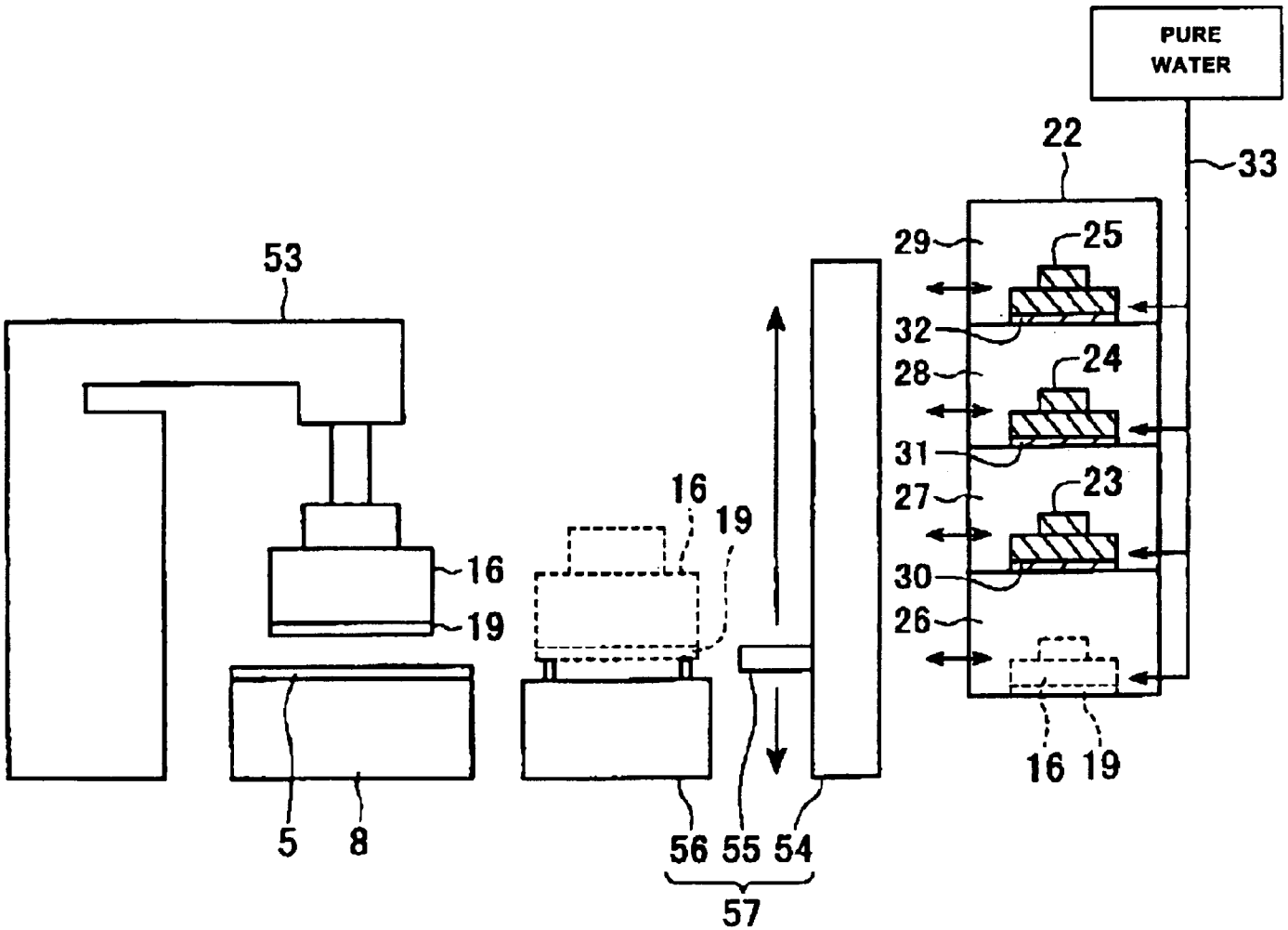
FIG. 1 shows a structural diagram illustrating the main structure of a CMP apparatus in accordance with an embodiment of the present invention.
Figure 2:
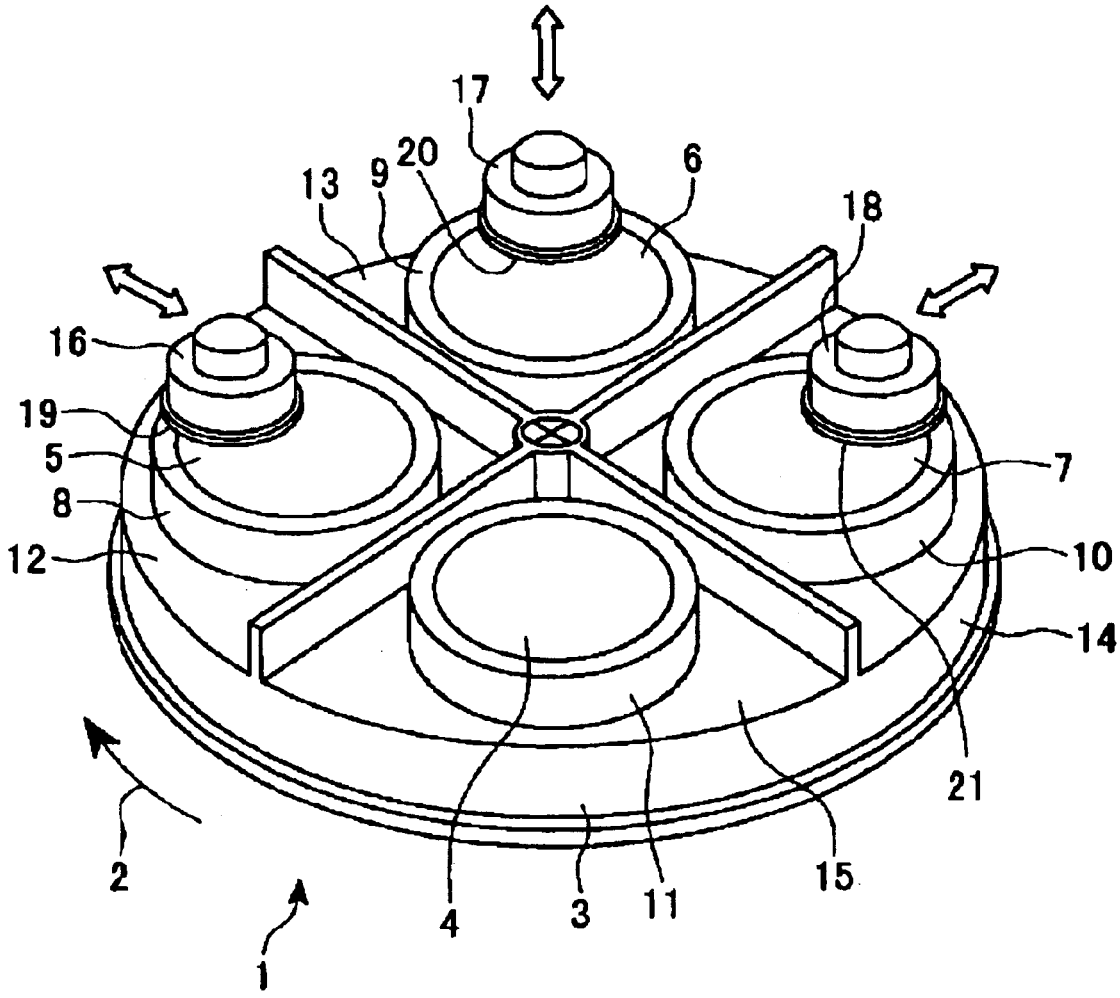
FIG. 2 schematically shows a view of a CMP apparatus equipped with a plurality of the CMP apparatuses of FIG. 1.

FIG. 1 is a structural diagram indicating a main structure of a CMP apparatus in accordance with an embodiment of the present invention. FIG. 2 schematically shows a CMP apparatus that is equipped with a plurality of the CMP apparatuses indicated in FIG. 1.

As shown in FIG. 2, a CMP apparatus 1 includes a turntable 3 in the shape of a disk that is rotatable in the direction of arrow 2, and first through fourth stages 8–11 that hold wafers 4–7, which are substrates to be polished, are independently disposed on the turntable 3. The first to third stages 8–10 are disposed at three polishing processing chambers 12–14, respectively, and the fourth stage 11 is disposed at a load-unload chamber 15. The polishing processing chambers 12–14 and the load-unload chamber 15 are partitioned from one another to prevent slurry at the time of polishing and contaminants from penetrating from one into the other stages.

First through third polishing heads 16–18 are disposed above the first through third stages 8–10, and first through third polishing pads 19–21 each in a generally circular shape in its plane configuration are retained at lower surfaces of the first through third polishing heads, respectively. Each of the polishing pads is formed to have a diameter that is smaller than a diameter of each wafer.

As indicated in FIG. 1, each of the polishing processing chambers 12–14 of the CMP apparatus 1 is equipped with a stage 8 that holds the wafer 5, a polishing head holding section 53 that holds the polishing head 16, a polishing head storage section 22 that stores replacement polishing heads 23–25, and a polishing head replacing mechanism 57. The stage is structured to be rotatable. The polishing head holding section 53 holds the polishing head 16 on the stage, and the polishing head 16 is equipped with the polishing pad 19. The replacement polishing heads 23–25 are quipped with polishing pads 30–32, respectively.

The polishing head storage section 22 is provided with first through fourth storage chambers 26–29 that store the four polishing heads 16, and 23–25, respectively, and the four storage chambers are mutually separated or partitioned from one another in order to prevent slurry and/or contaminants from penetrating from one to another storage chamber. The polishing pads 19, 30–32 are mounted on the polishing heads 16 and 23–25, respectively.

The polishing head replacing mechanism 57 is a mechanism that replaces the polishing head 16 that is retained by the polishing head holding section 53 with any of the replacement polishing heads 23–25 that are stored in the polishing head storage section 22. More specifically, the polishing head replacing mechanism 57 transfers each of the polishing heads 16 and 23–25 equipped with the polishing pads 19 and 30–32, which are stored in the first through fourth storage chambers 26–29, respectively, onto the stage 8 of the polishing processing chamber 12, and a polishing head equipped with a polishing pad on the stage 8 into any of the storage chambers, as indicated by arrows.

The polishing head replacing mechanism 57 includes a placing table 56. The placing table 56 is a table on which the polishing head 16 that is retained by the polishing head holding section 53 is temporarily placed. Also, the polishing head replacing mechanism 57 includes a replacing robot 54. The replacing robot 54 is provided with an arm 55. The polishing head 16 that is temporarily placed on the placing table 56 is picked up by the arm 55, and the polishing head 16 is placed in the storage chamber 26 of the polishing head storage section 22.

Consequently, polishing pads can be replaced by the polishing head replacing mechanism 57 according to polishing objects on the stage, such that plural types of polishing objects can be polished with a single CMP apparatus. For example, the apparatus may be controlled such that which one of the polishing heads equipped with the polishing pads 19 and 30–32 stored in the polishing head storage section 22 should be used can be designated for each of the processing conditions. For example, the apparatus may be controlled according to a setting such that the polishing pads 19 and 30 are used for $SiO_2$, the polishing pad 31 is used for Cu films, and the polishing pad 32 is used for W films. It is noted that the polishing pads can be readily replaced, by replacing the polishing pads together with the polishing heads.

For storing polishing heads that have been used in the first through fourth storage chambers 26–29, the apparatus is provided with a pure water circulation system 33 that circulates pure water in each of the first through fourth storage chambers 26–29 of the polishing head storage section 22. A polishing pad can be maintained in a dry state if it is not used. However, once a polishing pad is used, slurry adheres to the polishing pad. When the slurry dries, grinding particles within the slurry separate, such that the polishing pad can not be used any longer. For this reason, polishing pads need to remain submerged in pure water. Accordingly, by providing the pure water circulation system 33 in the present apparatus, pure water is circulated in each of the storage chambers. As a result, the polishing pads can be continuously submerged in pure water.

It is noted that the present embodiment uses the pure water circulation system 33, but without being limited to this embodiment, any other system can be used as long as it can prevent polishing pads from drying, which includes, for example, a system that submerge polishing pads in the polishing head storage section 22, and a system that sprays mist over polishing pads in the polishing head storage section 22.

Figure 3:
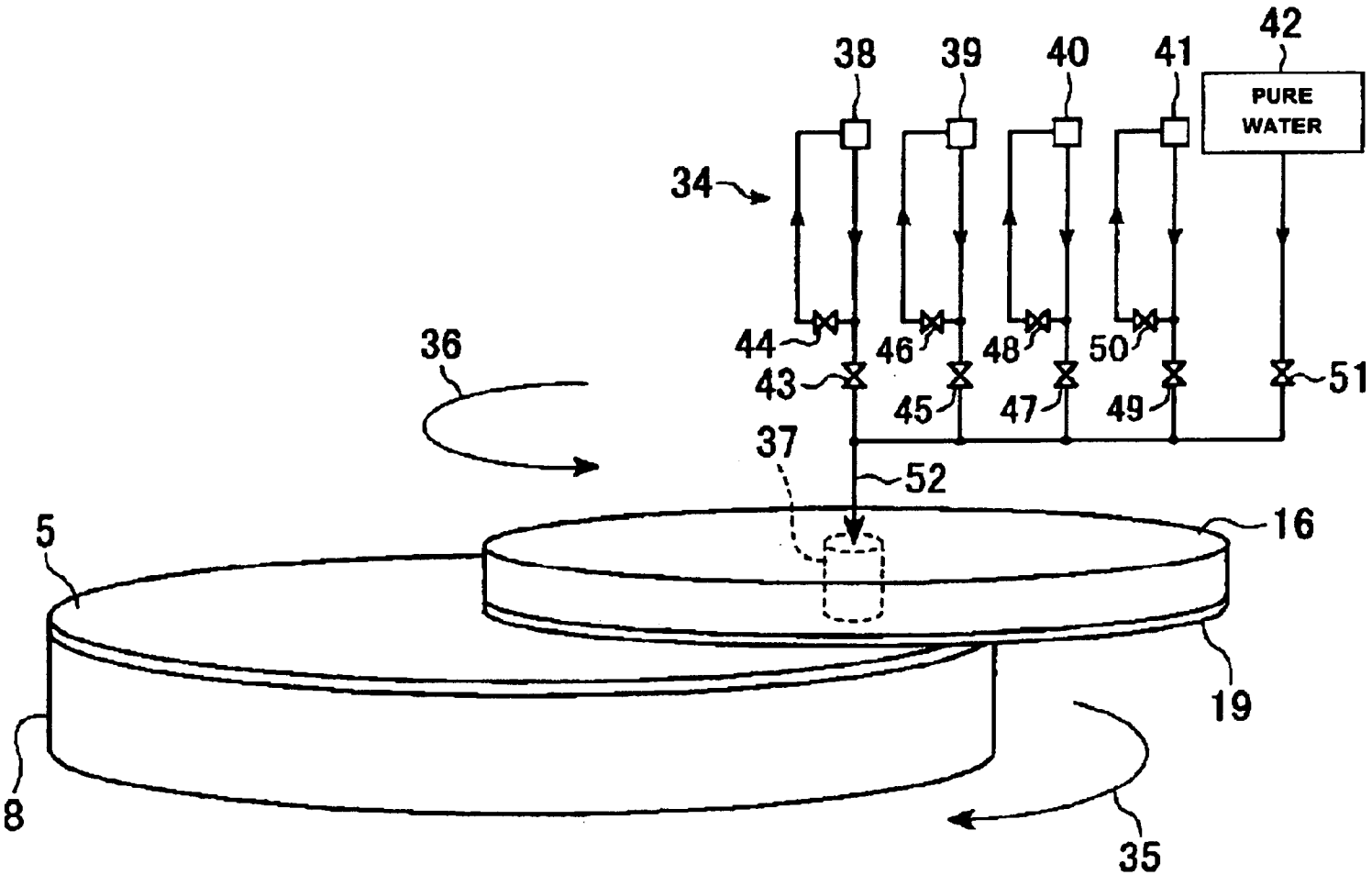
FIG. 3 shows a view of a slurry supply system, a polishing head and a stage of a polishing processing chamber.
Figure 4:
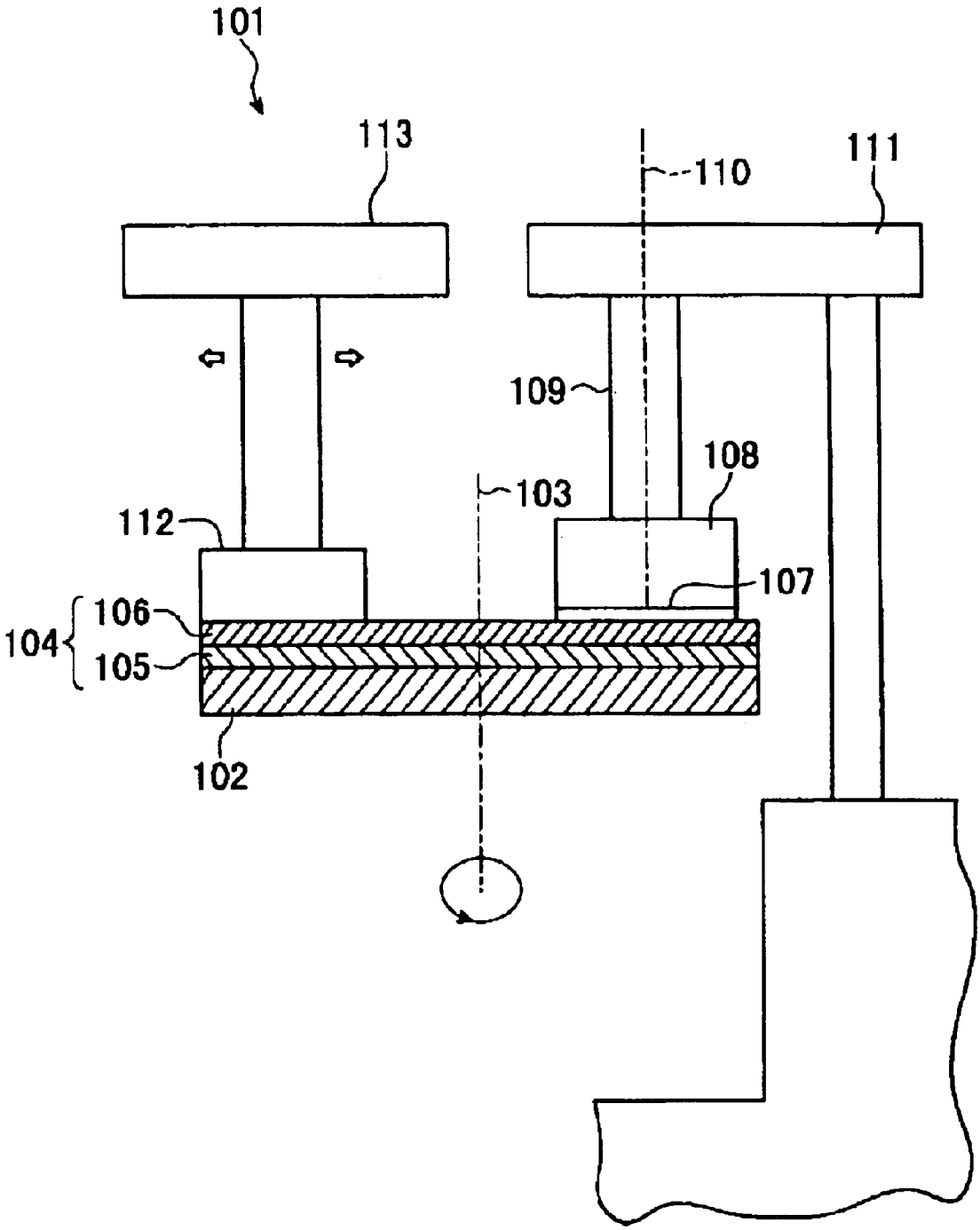
FIG. 4 PRIOR ART
FIG. 4 schematically shows a cross-sectional view of the structure of a conventional CMP apparatus.

FIG. 3 schematically shows a diagram of a slurry supply system, a polishing head and a stage in one of the polishing processing chambers of the CMP apparatus shown in FIG. 2.

As described above, the present apparatus is provided with three polishing processing chambers 12–14. However, since the slurry supply systems, the polishing heads and the polishing pads of the three polishing processing chambers have the same structure, only the polishing processing chamber 12 is taken as an example, and the first stage 8, the first polishing pad 19, the first polishing head 16 and a slurry supply system 34 in this polishing processing chamber are described.

A rotation motor (not shown) is provided under a lower surface of the first stage 8, which is a wafer holding means, through a rotation shaft (not shown). The first stage 8 rotates in a direction indicated by arrow 35. A wafer 5 is held on an upper surface of the first stage 8.

The first polishing head 16 that holds the first polishing pad 19 is disposed above the first stage 8, and a rotation motor (not shown) is provided above the first polishing head 16 through a rotation shaft (not shown). The first polishing head 16 rotates in a direction indicated by arrow 36.

Also, a pipe section 37 for conducting slurry that is supplied from the slurry supply system 34 to a central section of the polishing pad is provided in a center of the first polishing head 16. Also, an end point sensing device (not shown) that detects a polishing end point is disposed above the first stage 8.

The slurry supply system 34 needs to change the type of slurry according to objects to be polished in order to supply optimum slurry to the objects to be polished, like the polishing pads. Accordingly, the slurry supply system 34 is equipped with a first system for supplying a first slurry 38, a second system for supplying a second slurry 39, a third system for supplying a third slurry 40, a fourth system for supplying a fourth slurry 41, and a fifth system for supplying pure water 42.

The first system is connected to a valve 43 through a pipe line 52, and the pipe line 52 is connected to the pipe section 37. When the valve 43 is closed and a valve 44 is opened, the first slurry 38 circulates within the first system; and when the valve 43 is opened and the valve 44 is closed, the first slurry 38 is supplied from the first system through the pipe line 52 and the pipe section 37 to a central section of the top surface of the polishing pad 19. The second system is connected to the pipe line 52 through a valve 45. When the valve 45 is closed and a valve 46 is opened, the second slurry 39 circulates within the second system; and when the valve 45 is opened and the valve 46 is closed, the second slurry 39 is supplied from the second system through the pipe line 52 and the pipe section 37 to the central section of the top surface of the polishing pad 19.

The third system is connected to the pipe line 52 through a valve 47. When the valve 47 is closed and a valve 48 is opened, the third slurry 40 circulates within the third system; and when the valve 47 is opened and the valve 48 is closed, the third slurry 40 is supplied from the third system through the pipe line 52 and the pipe section 37 to the central section of the top surface of the polishing pad 19. The fourth system is connected to the pipe line 52 through a valve 49. When the valve 49 is closed and a valve 50 is opened, the fourth slurry 41 circulates within the fourth system; and when the valve 49 is opened and the valve 50 is closed, the fourth slurry 41 is supplied from the fourth system through the pipe line 52 and the pipe section 37 to the central section of the top surface of the polishing pad 19. Further, a pure water line is connected to the pipe line 52 through a valve 51. When the valve 51 is opened, the pure water 42 is supplied from the pure water line through the pipe line 52 and the pipe section 37 to the central section of the top surface of the polishing pad 19.

In the present apparatus, as described above, four kinds of slurry 38–41 can be switched, like the polishing pads. Thus, the optimum slurry may be used according to the objects to be polished. For example, as the first and second slurry 38 and 39 are set to be used for $SiO_2$, the third slurry 40 is set to be used for Cu films, and the fourth slurry 41 is set to be used for W films, the slurry supply lines can be switched in association with switching of the polishing pads according to objects to be polished.

Also, each slurry is circulated in the slurry supply system 34 as described above when the slurry is not supplied to the polishing pad. This is done because the slurry is a mixture of liquid and grinding particles, and the grinding particles readily separate and precipitate unless the slurry is kept in a flowing state.

Also, the pure water line is provided in the slurry supply system 34 for the following reason. When a plurality of slurries are switched and used, it is difficult to circulate all portions thereof although they are circulated as described above. Therefore, it is necessary to conduct flushing operations to flush pure water in the pipe line 52 to wash the inside of the line. In addition, since multiple kinds of slurry are switched and used according to the objects to be polished it is necessary to wash out any slurry remaining in the polishing processing chamber immediately after one slurry is switched to the other.

Next, a description will be made as to a method to polish wafers, as substrates to be polished, by the CMP apparatus 1 described above.

First, wafers 5–7 each having an $SiO_2$ film as an object to be polished formed thereon are prepared.

Next, as indicated in FIG. 1, the wafer 7 is mounted on and fixed to the stage in the load-unload chamber 15, and the turntable 3 is rotated through about 90° in a direction of arrow 2. Then, the wafer 6 is mounted on and fixed to the stage in the load-unload chamber 15, and the turntable 3 is rotated through about 90° in the direction of arrow 2. Then, the wafer 5 is mounted on and fixed to the stage in the load-unload chamber 15, and the turntable 3 is rotated through about 90° in the direction of arrow 2.

Next, each of the first through third stages 8–10 is rotated by the rotation motor in a direction of an arrow 35 indicated in FIG. 3, the polishing heads 16–18 equipped respectively with the polishing pads 19–21 are moved over to the corresponding stages, and the valves 44, 45, 47, 49 and 51 are closed, and the valves 43, 46, 48 and 50 are opened to supply the first slurry 38 from the first system to the central sections of the surfaces of the polishing pads 19–21. The polishing heads 16–18 are rotated by the rotation motor, and the polishing pads 19–21 are pressed against the surfaces (polishing surfaces) of the wafers 5–7. The first slurry 38 is supplied to the central section of the surface of the polishing pad 19, and spreads from the central section toward the entire surface of the polishing pad. Consequently, this can suppress the waste of slurry to a minimum amount compared to the conventional technology. In this manner, the $SiO_2$ film on the wafer is polished.

Thereafter, the polishing pad is moved up over the wafer, the rotation of the stage is stopped, the rotation of the polishing pad is stopped, and the supply of the slurry is stopped. Then, the turntable 3 is rotated through about 90° in the direction of arrow 2, the wafer 7 is removed from the stage of the load-unload chamber 15, and a wafer to be polished next is mounted on and fixed to the stage. Then, the turntable 3 is rotated through about 90° in the direction of arrow 2, the wafer 6 is removed from the stage of the load-unload chamber 15, and a wafer to be polished next is mounted on and fixed to the stage. Then, the turntable 3 is rotated through about 90° in the direction of arrow 2, the wafer 5 is removed from the stage of the load-unload chamber 15, and a wafer to be polished next is mounted on and fixed to the stage. Then, the wafers in the polishing processing chambers 12–14 are polished in a manner similar to the method described above. These operations are repeated to polish $SiO_2$ films on multiple wafers.

Next, wafers having objects to be polished other than $SiO_2$ films, such as, for example, Cu films formed thereon are prepared. Then, the pure water 42 is supplied from the pure water line indicated in FIG. 3 through the pipe line 52 and the pipe section 37 to the polishing pad 19 and the stage 8, to wash the stage and the polishing processing chamber with the pure water.

Then, by using the polishing head replacing mechanism 57 indicated in FIG. 1, the first polishing head 16 with the first polishing pad 19 mounted thereon is replaced with the third polishing head 24 with the third polishing pad 31 mounted thereon stored in the storage chamber of the polishing head storage section 22.

In other words, the first polishing head 16 held by the polishing head holding section 53 is mounted on the placing table 56, then the first polishing head 16 on the placing table 56 is picked up by the arm 55 of the replacing robot 54, and the first polishing head 16 is stored in the first storage chamber 26 of the polishing head storage section 22. Then, the third polishing head 24 stored in the third storage chamber 28 of the polishing head storage section 22 is taken out by the arm 55 of the replacing robot 54, the third polishing head 23 is mounted on the placing table 56, and then, the third polishing head 23 is held by the polishing head holding section 53 and moved over to the stage 8 of the polishing processing chamber.

Next, as indicated in FIG. 2, in a manner similar to the method described above, the wafers are held onto the stages of the polishing processing chambers, the stages are rotated, the valves 43, 45, 48, 49 and 51 indicated in FIG. 3 are closed, and the valves 44, 46, 47 and 50 are opened, to thereby supply the third slurry 40 for polishing the Cu films to the central sections of the surfaces of the polishing pads, the polishing heads are rotated, and the polishing pads are pressed against the surfaces (polishing surfaces) of the wafers. In this manner, the Cu films on the wafers are polished.

Then, processes similar to the method in which the $SiO_2$ films are polished are repeated, to polish the Cu films on the multiple wafers.

Next, when polishing objects to be polished other than Cu films, the polishing pads and the slurry can be switched to conduct the polishing in a manner similar to the case described above when the Cu films are polished.

According to the embodiment described above, plural kinds of objects to be polished can be polished by a single CMP apparatus, and cross-contamination that may become problematic in this instance can be suppressed. In other words, in the conventional technology, independent CMP apparatuses are needed to be used for different objects to be polished. In contrast, in accordance with the present embodiment, while suppressing cross-contamination, plural kinds of objects to be polished can be polished with a single CMP apparatus. Accordingly, the cost of the CMP apparatus can be reduced, and the efficiency of the CMP processing can be significantly improved, compared to the conventional technology.

In other words, conventionally, three or four kinds of CMP apparatuses are generally required in order to build one process line. In contrast, in accordance with the present embodiment, only one kind of CMP apparatus need be used to cover the entire process line. Accordingly, the usage efficiency of the facility is improved, and the manufacturing cost can be substantially reduced. Also, the number of paths in the polishing processing steps increases, such that the standby time in the flow of products can be shortened, and therefore the total time required for processing wafers can be substantially shortened. Also, even when the CMP apparatus is stopped for maintenance, the necessity to stop the flow of products is low as compared to the conventional CMP apparatus, and therefore losses that may be caused through stopping the flow of products can be suppressed to a low level.

It is noted that the present invention is not limited to the embodiment described above, and many modifications can be made and implemented. For example, the number of stages disposed on the turntable, the number of types of slurry that can be supplied by the slurry supply system 34, the number of storage chambers of the polishing head storage section 22 and the like can be appropriately changed, and implemented.

Also, in the embodiment described above, the polishing head replacing mechanism 57 composed of the replacing robot 54, the arm 55, and the placing table 56 is used. However, the structure of the polishing head replacing mechanism is not limited to this embodiment, and any other structure can be used as long as the other structure can replace polishing heads. For example, a polishing head replacing mechanism without a placing table (i.e., a polishing head replacing mechanism that is formed from a replacing robot and an arm) can be used.

Also, in accordance with the embodiment described above, an example in which the present invention is applied to a CMP apparatus and a CMP polishing method is described. However, without being limited to this embodiment, the present invention can be applied to semiconductor devices and a method for manufacturing the same. For example, semiconductor devices manufactured through steps in which polishing is conducted by using the CMP apparatus of the present embodiment, semiconductor devices manufactured through steps in which polishing is conducted by using the CMP polishing method of the present embodiment, methods for manufacturing semiconductor devices having polishing steps that use the CMP apparatus of the present embodiment, and methods for manufacturing semiconductor devices having polishing steps that use the CMP polishing method of the present embodiment are included in the applicable range of the present invention.

What is claimed is:

1. A CMP apparatus for polishing a substrate to be polished by CMP, the CMP apparatus comprising:

a rotatable stage selectively holding a substrate to be polished;

a polishing head holding section that holds a polishing head equipped with a polishing pad over the stage;

a storage section that stores a replacement polishing head equipped with a polishing pad;

a polishing head replacement mechanism that replaces the polishing head held by the polishing head holding section with the replacement polishing head stored in the storage section;

a pure water circulation system that circulates pure water at the storage section such that the polishing pad stored in the storage section remains wet; and at least one of a mechanism that submerges the polishing pad in the storage section in pure water and a mechanism that sprays mist on the polishing pad in the storage section.

2. A CMP apparatus according to claim 1, wherein:

the storage section includes storage chambers that store replacement polishing pads; and the storage chambers are mutually partitioned such that slurry and contaminants are prevented from crossing from one storage chamber to another storage chamber.

3. A CMP apparatus according to claim 1, wherein the polishing pad has a diameter smaller than a diameter of the substrate to be polished.

4. A CMP apparatus according to claim 1, further comprising:

a pure water circulation system that circulates pure water at the storage section such that the polishing pad stored in the storage section remains wet; and at least one of a mechanism that submerges the polishing pad in the storage section in pure water and a mechanism that sprays mist on the polishing pad in the storage section.

5. A CMP apparatus according to claim 1, further comprising:

a slurry supply system that supplies slurry at a central section of the polishing pad of the polishing head that is held by the polishing head holding section, wherein the slurry supply system includes:

a plurality of slurry supply systems that supply slurry; and a switching device that switches among the slurry supply systems.

6. A CMP apparatus according to claim 5, wherein the plurality of slurry supply systems includes a circulation system that circulates slurry in the slurry supply systems while the slurry is not being supplied to the polishing pad.

7. A CMP apparatus according to claim 5, further comprising:

a pure water supply device that supplies pure water at a central section of the polishing pad of the polishing head that is held by the polishing head holding section.

8. A semiconductor device manufactured through the steps of polishing using the CMP apparatus recited in claim 1.

9. A method for manufacturing a semiconductor device comprising the steps of polishing using the CMP apparatus recited in claim 1.

10. A CMP apparatus for polishing a substrate to be polished by CMP, the CMP apparatus comprising:

a plurality of polishing processing chambers disposed on a turntable;

a rotatable stage that is disposed in each of the polishing processing chambers and selectively holding a substrate to be polished;

a polishing head holding section that holds a polishing head equipped with a polishing pad over the stage;

a storage section that stores a replacement polishing head equipped with a polishing pad;

a polishing head replacement mechanism that replaces the polishing head held by the polishing head holding section with the replacement polishing head stored in the storage; and a slurry supply system that supplies slurry at a central section of the polishing pad of the polishing head that is held by the polishing head holding section, the slurry supply system including a plurality of slurry supply systems that supply slurry and a switching device that switches among the slurry supply systems;

wherein the polishing processing chambers are partitioned such that slurry and contaminants are prevented from crossing from one polishing processing chamber to another polishing processing chamber.

11. A CMP apparatus according to claim 10, further comprising:

a load-unload chamber that is disposed over the turntable for mounting and removing the substrate to be polished on and from the stage.

12. A CMP apparatus according to claim 10, wherein the polishing pad has a diameter smaller than a diameter of the substrate to be polished.

13. A CMP apparatus according to claim 10, wherein the plurality of slurry supply systems includes a circulation system that circulates slurry in the slurry supply systems while the slurry is not being supplied to the polishing pad.

14. A CMP apparatus according to claim 10, further comprising:

a pure water supply device that supplies pure water at a central section of the polishing pad of the polishing head that is held by the polishing head holding section.

15. A semiconductor device manufactured through the steps of polishing using the CMP apparatus recited in claim 10.

16. A method for manufacturing a semiconductor device comprising the steps of polishing using the CMP apparatus recited in claim 10.

17. A CMP polishing method using a CMP apparatus including a rotatable stage selectively holding a substrate to be polished, a polishing head holding section that holds a polishing head equipped with a polishing pad over the stage, a storage section that stores a replacement polishing head equipped with a polishing pad, a polishing head replacement mechanism that replaces the polishing head held by the polishing head holding section with the replacement polishing head stored in the storage section, a pure water circulation system that circulates pure water at the storage section such that the polishing pad stored in the storage section remains wet, and at least one of a mechanism that submerges the polishing pad in the storage section in pure water and a mechanism that sprays mist on the polishing pad in the storage section, the CMP polishing method comprising the steps of:

submerging the polishing pad in the storage section in pure water;

circulating pure water at the storage section to maintain the polishing pad stored in the storage section wet;

spraying mist on the polishing pad in the storage section; and polishing the substrate to be polished by holding the substrate to be polished on the stage, rotating the stage, and pressing the polishing pad against a polishing surface of the substrate to be polished while rotating the polishing head held by the polishing head holding section.

18. A semiconductor device manufactured through the steps of polishing using the CMP polishing method recited in claim 17.

19. A method for manufacturing a semiconductor device comprising the steps of polishing using the CMP polishing method recited in claim 17.

20. A CMP polishing method using a CMP apparatus for polishing a substrate to be polished by CMP, the CMP apparatus including a plurality of polishing processing chambers disposed on a turntable, a rotatable stage that is disposed in each of the polishing processing chambers, and selectively holding a substrate to be polished, a polishing head holding section that holds a polishing head equipped with a polishing pad over the stage, a storage section that stores a replacement polishing head equipped with a polishing pad, a polishing head replacement mechanism that replaces the polishing head held by the polishing head holding section with the replacement polishing head stored in the storage section, and a slurry supply system that supplies slurry at a central section of the polishing pad of the polishing head that is held by the polishing head holding section, the slurry supply system including a plurality of slurry supply systems that supply slurry and a switching device that switches among the slurry supply systems, wherein the polishing processing chambers are mutually partitioned such that slurry and contaminants are prevented from crossing from one polishing processing chamber to another polishing processing chamber, the CMP polishing method comprising the steps of:

supplying slurry at the central section of the polishing pad of the polishing head;

polishing a first substrate to be polished by holding the first substrate to be polished on the stage, rotating the stage, and pressing the polishing pad against a polishing surface of the first substrate to be polished while rotating the polishing head held by the polishing head holding section;

removing the first substrate to be polished from the stage upon completion of the polishing, replacing the polishing head held by the polishing head holding section with the replacement polishing head, holding a second substrate to be polished having a polishing object different from the first substrate to be polished on the stage, supplying slurry at the central section of the polishing pad of the polishing head, and polishing the second substrate to be polished by rotating the stage, and pressing the polishing pad against a polishing surface of the second substrate to be polished while rotating the polishing head.

21. A semiconductor device manufactured through the steps of polishing using the CMP polishing method recited in claim 20.

22. A method for manufacturing a semiconductor device comprising the steps of polishing using the CMP polishing method recited in claim 20.

* * * * *